US005706868A

United States Patent [19]

Fritzson et al.

[11] Patent Number: 5,706,868

[45] Date of Patent: Jan. 13, 1998

[54] YARN BRAKE ASSEMBLY HAVING A GUIDE ELEMENT FOR BYPASSING A YARN BRAKE DURING THREADING

[75] Inventors: Joachim Fritzson, Ulricehamn; Staffan Hagstroem, Timmele; Per Ohlson, Tvaerred, all of Sweden

[73] Assignee: IRO AB, Ulricehamn, Sweden

[21] Appl. No.: 569,184

[22] PCT Filed: Jun. 16, 1994

[86] PCT No.: PCT/EP94/01954

§ 371 Date: May 30, 1996

§ 102(e) Date: May 30, 1996

[87] PCT Pub. No.: WO94/29207

PCT Pub. Date: Dec. 22, 1994

[30] Foreign Application Priority Data

Jun. 16, 1993 [DE] Germany ..... 43 19 960.7

[51] Int. Cl.[6] ..... B65H 59/22; D03D 47/34

[52] U.S. Cl. ..... 139/194; 139/450; 242/149; 242/419.3; 242/419.4

[58] Field of Search ..... 139/194, 450; 242/149, 150 R, 419.4, 419.3

[56] References Cited

U.S. PATENT DOCUMENTS 3,945,184 3/1976 Franzen ..... 242/149
4,468,920 9/1984 Lorenz ..... 242/149
4,641,688 2/1987 Gehring .
5,368,244 11/1994 Melillo et al. .

FOREIGN PATENT DOCUMENTS 0 450 686 A1 10/1991 European Pat. Off. .
29 06 811 C2 1/1984 Germany .
34 09 179 A1 9/1985 Germany .
34 46 567 C1 5/1986 Germany .
WO 91/05728 5/1991 WIPO .

*Primary Examiner*—Andy Falik
*Attorney, Agent, or Firm*—Flynn, Thiel, Boutell & Tanis, P.C.

[57] ABSTRACT

In a device for guiding and braking a yarn, a yarn brake comprises braking elements that are pressed flexibly against each other and act on the yarn in a pinch zone. The yarn brake is arranged in the yarn running path between a yarn feeder and a yarn receiver. A pneumatic threader also is provided which includes at least one air and yarn guide element that is disposed in the yarn brake and surrounds the pinch zone without contact. The air and yarn guide element comprising a receiving end, a delivery end and a guide channel provided therebetween, which is open towards the braking elements and from which the yarn is introduced into the pinch zone. The yarn is conveyed into the guide channel by means of an air flow past the pinch zone to the yarn receiver and is introduced into the pinch zone under the action of a produced drawing force.

17 Claims, 4 Drawing Sheets

YARN BRAKE ASSEMBLY HAVING A GUIDE ELEMENT FOR BYPASSING A YARN BRAKE DURING THREADING

FIELD OF THE INVENTION

The present invention relates to a device of the type which includes a yarn feeder, a yarn receiver and a yarn brake.

BACKGROUND OF THE RELATED ART

In a device of this type, as is known from WO 91-05728, the problem of automatic threading which is almost unavoidable in modern yarn-processing systems is already taken into account to avoid expensive and long standstill times for manually threading the yarn into the yarn brake. However, the yarn which is supplied from the yarn feeder and conveyed by the pneumatic threader is transported along the running path of a normal yarn run through the pinch zone, and either a drive must adjust the braking elements into a threading position where they are separated, or the air flow must be so vigorous that it presses the braking elements apart from each other to release a passage for the yarn. With this principle, expensive technical means are needed for adjusting the braking elements into the threading position. The yarn receiver does not participate in the threading operation. This principle is difficult to put into practice for devices including a disc brake.

A yarn storing and delivering device which is known from EP-0 450 686 A1 is equipped with a pneumatic threader which comprises a slotted tube extending over a considerable portion of the axial length of the storing drum. The tube serves to transport the yarn blown forwardly by means of an air flow and extends externally over a bristle-type brake ring which rests with brake bristles on a withdrawal edge of the storing drum. The bristle-type brake ring has a circumferential interruption.

The slit of the tube is not oriented towards the circumferential interruption of the brake ring, but is offset about 90° relative thereto, so that after threading the yarn is first removed laterally from the tube before it first passes between the brake bristles and then below said bristles. The tube extends in a direction perpendicular to the plane defined by the pinch zone.

A disc brake which is known from DE-34 09 179 A1 is threaded manually, just like a lamella brake known from DE-34 46 567 C1.

It is the object of the present invention to provide a device of the above-mentioned type in which threading of the yarn into the yarn brake is made easier and can be carried out with simpler constructional means.

SUMMARY OF THE INVENTION

This object is achieved according to the invention wherein a channel-like guide element is disposed adjacent to the pinch zone of a yarn brake to permit the yarn to bypass the pinch zone during threading.

In this configuration, the yarn to be threaded is deliberately moved out of the yarn running path during normal (braked) yarn run and forced to obviate or bypass the pinch zone. This has the advantage that the adjustment of the braking elements need not be changed for threading, and that auxiliary means are not needed for adjusting the braking elements for threading purposes. After the yarn has reached the yarn receiver by obviating the pinch zone, the drawing force in the yarn is exploited to introduce the yarn into the pinch zone in a direction transverse to its running direction by way of stretching. This is advantageous because the transverse force of the yarn which surrounds the braking elements without contact, which force has been created under the drawing force, is capable of pressing the braking elements slightly apart from each other, so that the yarn is introduced without any significant mechanical load into the pinch zone only when the free yarn end has already reached the yarn receiver and the yarn is also supported by said receiver. Hence, the yarn is not left alone when being introduced into the pinch zone. The yarn detour which first obviates the pinch zone is deliberately accepted, and the yarn is then transferred via the drawing force between yarn feeder and yarn receiver into the normal yarn running path and the pinch zone. Threading is made simple with the aid of simple constructional means. The ratio of incorrect threadings is virtually reduced to zero.

BRIEF DESCRIPTION OF THE DRAWINGS

Embodiments of the subject matter of the invention shall now be explained with reference to the drawing, in which.

DETAILED DESCRIPTION

Figure 1:
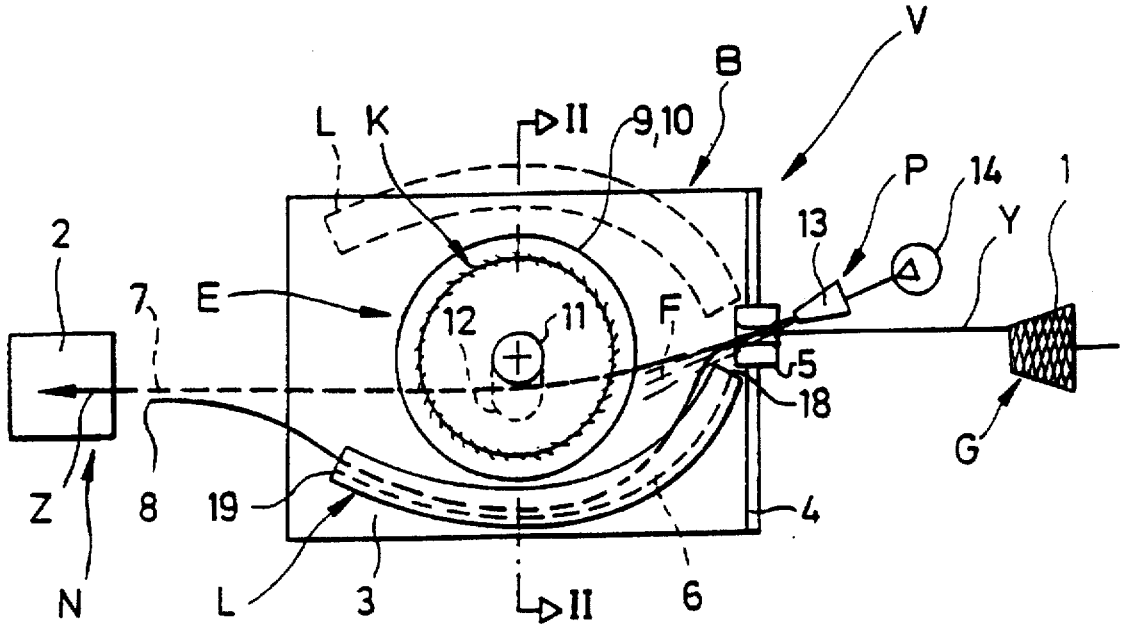
FIG. 1 is a diagrammatic lateral view of a device for guiding and braking a yarn, with the device containing a disc brake.

A device V for guiding and braking a yarn Y extending approximately in a linear direction is integrated into a yarn-processing system in a manner not shown in detail. Device V comprises a yarn feeder G from which yarn Y extends to a yarn receiver N that exerts a drawing force Z on yarn Y. Part of the device is a yarn brake B which is provided between yarn feeder G and yarn receiver N on the normal yarn running path 7, which is illustrated in broken line. The yarn feeder G is, for instance, a supply coil 1 from which yarn Y is removed. Yarn receiver N may be a yarn storing and delivering device or the insertion device of a weaving machine or of another apparatus (for instance on a knitting machine) which consumes yarn or delivers it onwards. For instance, yarn receiver N is an inlet device 2 of a yarn delivering and storing device which exerts the drawing force Z on yarn Y.

Figure 2:
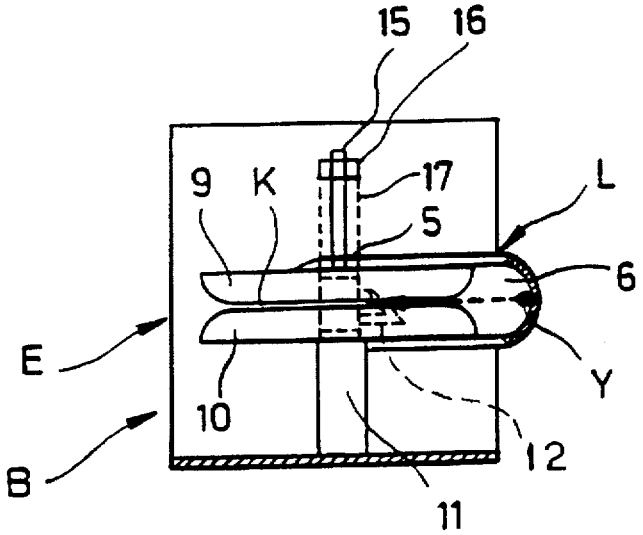
FIG. 2 is a section taken in plane II—II of FIG. 1.

The yarn brake B according to FIGS. 1 and 2 comprises a basic or main body 3 including a flange 4 in which a yarn guiding element or yarn guide 5, such as a yarn eyelet, is accommodated along the normal yarn running path 7. Two braking elements rest resiliently and flexibly on each other in yarn brake B. These are circular brake discs 9, 10 which define a circular pinch zone K through which yarn Y passes along the normal yarn running path 7 to be braked. Brake discs 9, 10 are movably supported on a pin 11 which is arranged on basic body 3. A yarn guiding hook, 12 into which yarn Y is hung eccentrically relative to the axis of the brake dics 9, 10 is optionally provided between the brake discs 9, 10.

A guide element L which surrounds the braking elements E without contact in the manner of a bicycle mudguard and which is used for threading yarn Y into yarn brake B is provided in yarn brake B. Furthermore, there is provided a pneumatic threader P which in the illustrated embodiment contains a directional nozzle 13 connected to a source 14 of compressed air. The directional nozzle 13 has a blow-out direction which extends approximately in the direction of the yarn running path 7 or in a direction inclined thereto, so that an air flow F can be produced. Guide element L is positioned in the plane of pinch zone K and of the normal yarn running path 7 and has an arcuate shape. Guide element L has a receiving end 18 near the yarn guiding element 5 and a delivery end 19 which is positioned behind the braking elements E when viewed in the yarn running direction and is oriented towards the yarn receiver N. In guide element L, a guide channel 6 which is open towards pinch zone K is provided for air flow F and yarn Y.

According to FIG. 2, guide channel 6 has a U-shaped or V-shaped cross-section. The upper brake disc 9 is movable along a setscrew 15 and is pressed in the pinch zone by means of an adjustable stop 16 and a spring 17 against brake disc 10.

In FIGS. 1 and 2, guide element L is illustrated at a cross-sectional distance from braking elements E. The width of guide channel 6 corresponds approximately to the distance of the edges of the brake discs 9 and 10 which are adjacent to each other. However, it is also possible to make the width of guide channel 6 smaller or larger than the distance of the edges of brake discs 9, 10. Optionally, guide channel 6 grips laterally around the edges of brake discs 9, 10, at least in the area in which guide element L extends near brake discs 9, 10 in FIG. 1. Instead of a U-shaped cross-section, guide channel 6 may have a V-shaped or a trough-like cross-section. The depth of guide channel 6 may vary over the longitudinal extension of guide element L, just like the inclination of the side walls of guide channel 6 or the inner curvature of guide channel 6. Furthermore, guide element L may be enlarged near yarn guiding element 5 to take over yarn Y more easily. The open side of guide channel 6 may be covered by one or two elastic lips or soft bristles which are pushed away by the yarn when the latter is being stretched.

The directional nozzle 13, which may also be integrated into the yarn guiding element 5 or flange 4, is expediently provided with a blow-out direction obliquely inclined relative to guide element L. The blow-out direction, however, may also be oriented approximately in the direction of the yarn running path 7. In this case, a second guide element L has to be provided symmetrically (FIG. 1, shown in broken line). The air flow is here divided at brake discs 9, 10, so that yarn Y is conveyed along the one or the other guide element L. The yarn guiding hook 12 is of a double type, so that yarn Y can reliably be guided by the yarn guiding hook 12 between brake discs 9, 10 after having been threaded.

Figure 3:
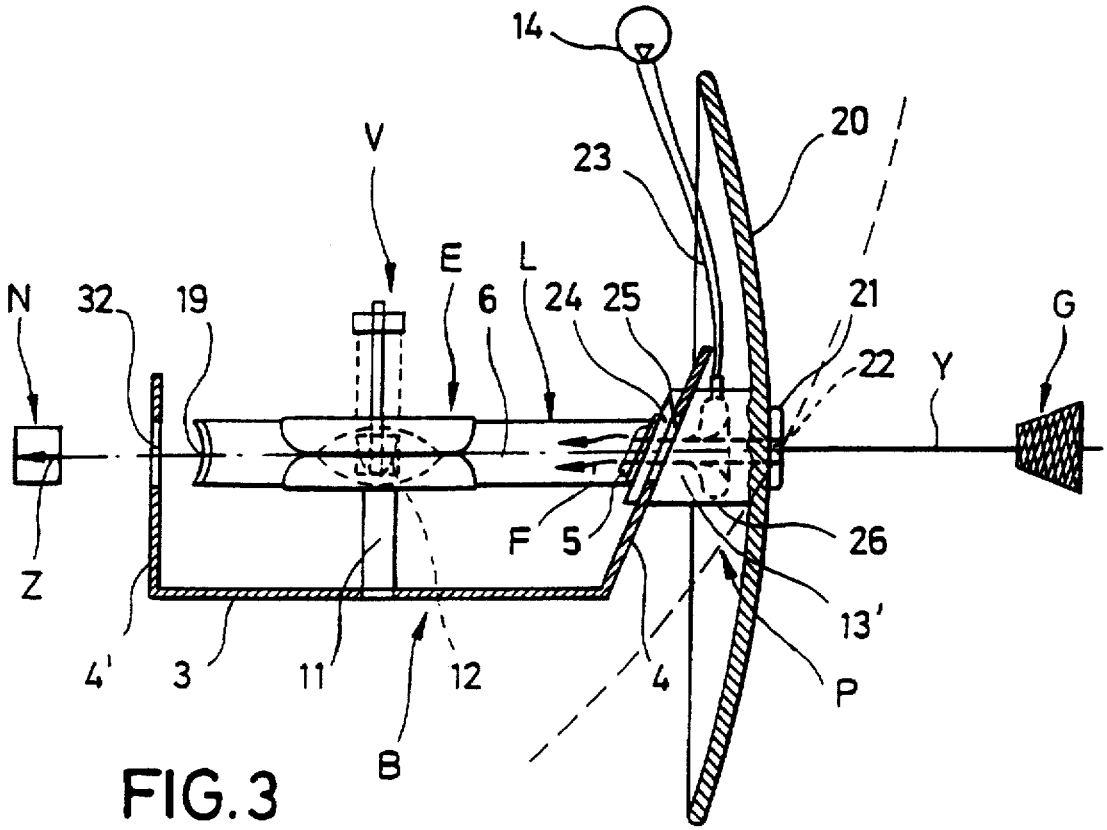
FIG. 3 is a top view of another embodiment.

FIG. 3 shows an embodiment in which the yarn brake B is equipped at the inlet side with a shielding surface 20 which is secured to flange 4 of basic body 3. Furthermore, a second flange 4' is provided at the outlet side of yarn brake B, the second flange including a passage opening 32 for the yarn. A bulge which is directed upwardly and downwardly, respectively, is outlined in broken line at braking elements E. The yarn guiding hook 12 is accommodated between the bulges. The shielding surface 20 which is either planar or convexly curved at the inlet side optionally contains a yarn eyelet 21 and a longitudinal passage 22 in a base part 26 by which the shielding surface 20 is fixed to flange 4 in an opening 25. Flange 4 is inclined, and also the contact surface of base member 26. A clamping nut 25 clamps base member 26 against flange 4. The shielding surface 20 can be adjusted to the respective feed direction of yarn Y by turning shielding surface 20 in opening 25.

An ejector, suction and blow nozzle which is connected to a source of pressure 14 via a line 23 and produces air flow F towards guide element L as well as a suction flow at the inlet side is incorporated into the base member 26 as a directional nozzle 13'. If there is only one guide element L, air flow F is obliquely oriented relative to guide channel 6. If, like in FIG. 1, there are two symmetrically arranged guide elements L, air flow F may also be directed centrally onto braking elements E. Since upon turning of the shielding surface 20 in FIG. 3 the longitudinal passage 22 changes its angular position and since air flow F might thus change its direction in an undesired manner, it is expedient when the directional nozzle 13' is accommodated in the part of head member 26 that faces the braking elements E and does not change its orientation when base member 26 is being turned. It would also be possible to provide a separate blow nozzle and suction nozzle to suck in yarn Y and to convey it into the guide channel.

Figure 4:
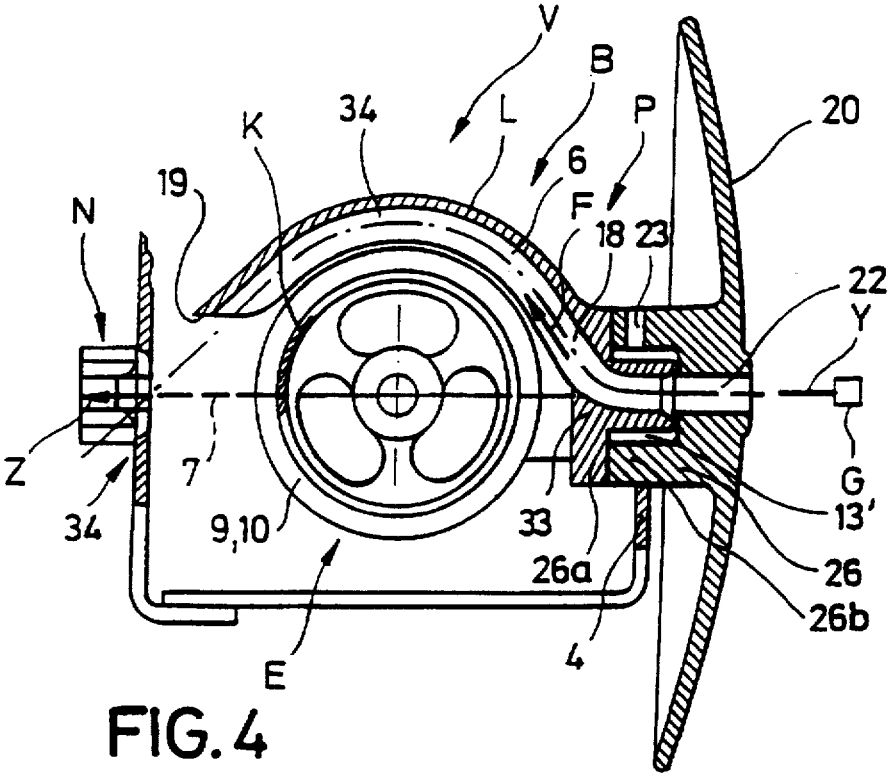
FIG. 4 is a lateral view of another variant.

Yarn brake B of device V according to FIG. 4 approximately corresponds to yarn brake B of FIG. 3. The difference is that the shielding surface 20 is retained with its base member 25 in a fixed position on flange 4. The base member 26 consists of two molded members **26*a*, 26*b* which are inserted into each other and form the directional nozzle 13', i.e., an ejector, suction and blow nozzle. The nozzle is connected via connection 23 to the source of pressure 14 (not shown) and is operative into the longitudinal passage 22 to produce a suction flow at the side facing yarn feeder G and air flow F into guide channel 6 of guide element G. Guide element G is, for instance, integrally connected to member 26*a* of base member 26 and designed like a mudguard of a bicycle, so that it surrounds the brake discs 9, 10 and is oriented with its outlet end 19 towards the normal yarn running path 7. The yarn brake B is mounted on yarn receiver N, for instance, at an inlet nozzle or an inlet yarn eyelet of a yarn storing and delivering device 34. To make the air flow F flow into guide channel 6, a deflection nose 33 is molded onto the end of the longitudinal passage 22 which faces the braking elements E, and the outlet of the longitudinal passage 2 is enlarged upwards. Instead of the deflection nose 33, there could also be provided a transverse journal of a wear-resistant material (ceramic material) which, however, does not present an obstacle to yarn Y on the normal yarn running path 7. The normal yarn running path 7 extends in an approximately straight manner from the longitudinal passage 22** to the yarn receiver N.

Figure 5:
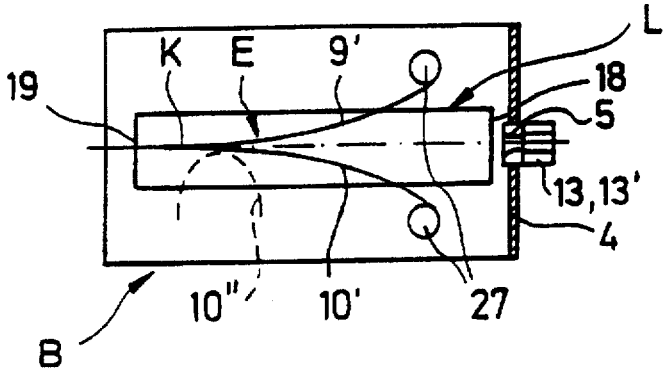
FIG. 5 is a top view of a thread brake of the lamella brake type.
Figure 6:
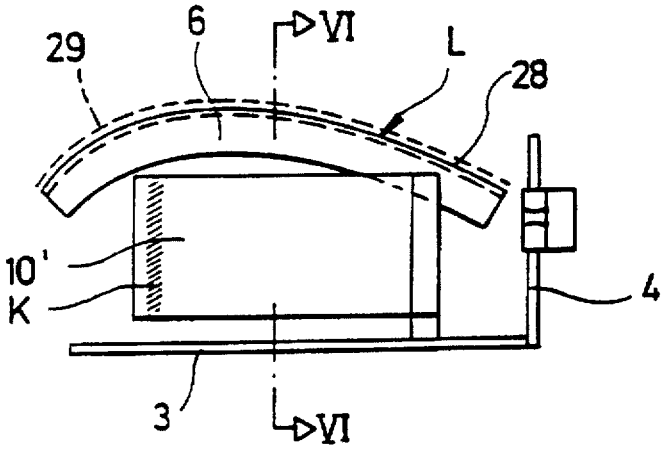
FIG. 6 is a lateral view with respect to FIG. 5.
Figure 7:
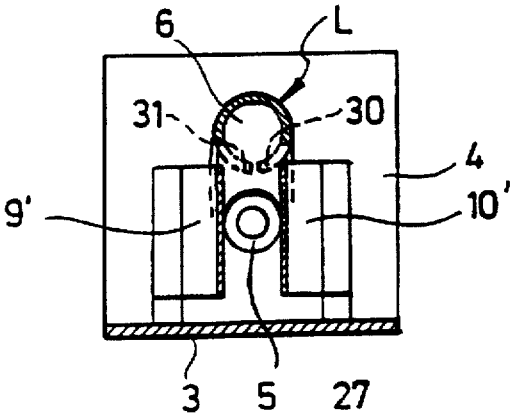
FIG. 7 is a sectional view in plane VI—VI of FIG. 6.

FIGS. 5–7 shows a lamella-type yarn brake B which, instead of the disc brake, can be inserted into the device according to FIGS. 1 to 3. The yarn brake B according to FIGS. 5 to 7 comprises the basic body 3 with flange 4 and yarn guiding element 5. The braking elements E are two brake lamellae 9', 10' which are approximately rectangular and which are retained on supports 27 and form an inlet nip which tapers in the yarn running direction up to pinch zone K. The two brake lamellae 9', 10' are resiliently pressed against each other, defining pinch zone K which is positioned in a direction perpendicular to the drawing plane of FIG. 5 and perpendicular to the yarn running direction. Instead of the second brake lamella 10', a stationary abutment 10", such as a journal or a pin, could also be provided.

The guide element L starts near the yarn guiding element 5 and grips in this area optionally between brake lamellae 9', 10'. The guide element L then extends with its guide channel 6 upwards beyond the brake lamellae 9', 10' and then downwards with a final curvature. Guide channel 6 according to FIG. 5 may have different radii of curvature 28 over the longitudinal extension of the guide element. It is also possible to compose guide element L of straight sections or to form it with straight sections that are each adjacent to one another via obtuse angles (outlined in broken line at 29).

Alternatively, it is outlined in broken line in FIG. 7 that guide element is formed in the manner of a closed round or sectional tube 30 with a longitudinal slot 31 on whose edge an elastic cover surface or bristles may optionally be provided. The longitudinal slot 31 faces pinch zone K.

Figure 8:
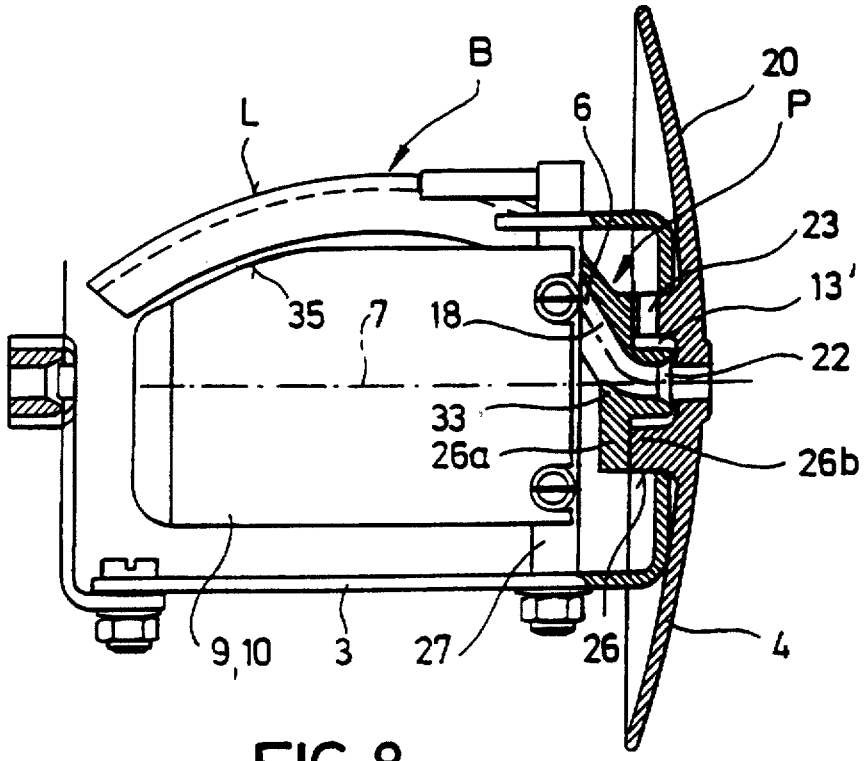
FIG. 8 is a lateral sectional view of a variant.

The yarn brake B shown in FIG. 8 corresponds essentially to yarn brake B of FIGS. 5 to 7. The arrangement of the shielding surface 20 on flange 4 of basic body 3 is different, with the base member 26 of the shielding surface 20, which is provided for securing shielding surface 20, containing the directional nozzle 13' in the form of an ejector, suction and blow nozzle which is operative into the longitudinal passage 22. A deflection nose 33 which deflects the air flow into guide channel 6 of guide element L is molded onto the end of the longitudinal passage 22 which faces brake lamellae 9', 10'. Guide element L grips over the ends of the two brake lamellae 9', 10', the ends being rearwardly positioned in the yarn running direction. As illustrated at 35, the upper corners of the two brake lamellae 9', 10' may be cut off to create a distance relative to the guide element and in order to present no obstacle to the travel of the threaded yarn.

Figure 9:
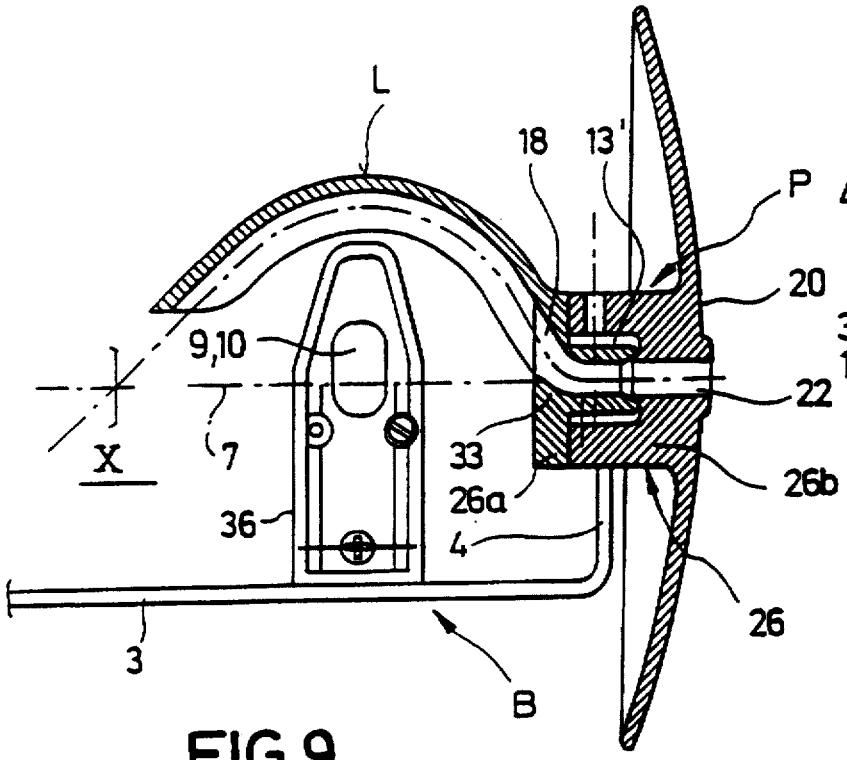
FIG. 9 is a lateral sectional view of another embodiment.
Figure 10:
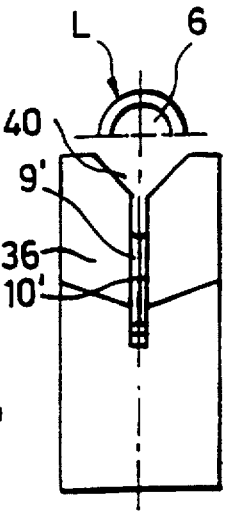
FIG. 10 is a detail variant of FIG. 9 in viewing direction X.

The embodiment of the yarn brake B according to FIGS. 9 and 10 relates to a so-called "small" lamella brake which is similar to a disc brake. In a housing 36 mounted on basic body 3, two brake surfaces 9', 10' which are formed in the manner of brake lamellae and are approximately rectangular and spring-loaded are retained with outwardly rounded edges between which the yarn is clamped on the normal yarn running path 7. The shielding surface 20 is fixed with its base member 26 onto flange 4. The base member 26 is bipartite and contains the directional nozzle 13', i.e., an ejector, suction and blow nozzle which is operative into the longitudinal passage 22. The guide element L is made integral with base member 26 or the part of base member 26 that forms a deflection nose 33, and guide element L grips beyond housing 36.

As shown in FIG. 10, housing 36 has a gusset-like inlet 40 relative to brake surfaces 9', 10' which, with guide channel 6 and at least over part of the longitudinal extension of guide element L, defines a flow-promoting and substantially closed flow passage in which the yarn conveyed in guide channel 6 is reliably displaced towards the ground of guide channel 6. It would also be possible to design guide element L such that it is displaced in FIG. 10 into the gusset-like inlet nip 40 of housing 36.

In all of the illustrated embodiments of FIGS. 1 to 10, the directional nozzle 13, 13' is activated for threading yarn Y. The yarn end moved in any desired manner to the receiving end 18 of guide element L, or the free yarn end sucked by the suction effect of the ejector, suction and blow nozzle, is conveyed into the guide channel 6. The air flow F then pushes yarn Y forwards along the guide channel obviating the pinch zone until the free yarn end is taken up by the yarn receiver N and acted upon by a drawing force. Yarn Y which first follows detour 34 is stretched by the drawing force and transferred into the pinch zone in a direction transverse to the normal yarn running path 7, the yarn being either lifted from the open guide channel 6 or drawn through the longitudinal slot 31 (FIG. 7). As soon as yarn Y has again passed into the normal yarn running path 7 in an orderly manner, the action of the directional nozzle 13, 13' will be terminated.

As discussed herein, with the curved course or shape of the guide element, the embodiment of FIG. 5 where the guide element has different radii of curvature 28 is conducive to a delivery of the yarn to be threaded that offers as little resistance as possible.

In the alternative embodiment wherein the guide element comprises a plurality of straight sections identified by reference numeral 29 as discussed herein with respect to FIG. 5, the obtuse corners in the course or shape of the guide element present no obstacle to yarn transport. The guide element can be produced in a simple manner and is adapted to the constructional conditions of the braking elements.

In the embodiment wherein the guide element has a U-shape or V-shape as discussed herein with respect to FIGS. 1 and 2, the air flow follows the guide element reliably. The yarn is taken along the guide element and expediently forced into the bend of the U or V, so that it cannot escape laterally.

An especially expedient embodiment is provided where the guide element is open towards the pinch zone through a narrow longitudinal slot 31 as discussed herein with respect to FIG. 7. As soon as the yarn has entered into the guide element, it can no longer escape its predetermined detour laterally. It is only upon the action of the drawing force which stretches the yarn that the yarn is removed through the longitudinal slot and drawn into the pinch zone.

An especially expedient embodiment also is provided where the brake discs of a disc brake are provided as discussed herein with respect to FIGS. 1 and 2. Disc brakes are often used as thread brakes in yarn-processing systems. With the guide element, the problem of automatic threading which has so far been difficult to handle is easily solved. The guide element extends over almost half of the circumference of the brake disc. With the restriction formed by their circumferences, the brake discs cooperate with the guide element, so that the air flow is regular and the yarn is advanced rapidly.

The alternative embodiment of FIGS. 5–7 is a so-called lamella brake (leaf spring brake) having the brake lamella 9' and an abutment 10', such as a journal or pin, or two brake lamellae 9' and 10'. The guide element guides the yarn to be threaded past the pinch zone into which the yarn is then easily drawn from the side.

In the embodiment wherein the yarn guiding element 5 (FIG. 1) is formed as a yarn eyelet, the guide element L serves to correctly support the yarn during normal yarn run to keep it in the pinch zone. During threading, the yarn inside the yarn guiding element 5 has a starting point from which it passes reliably along the guide element L towards the yarn receiver. As soon as the drawing force by the yarn receiver becomes effective in the yarn, the yarn will be supported and stretched between the yarn receiver and the yarn guiding element 5, so that it can easily enter into the pinch zone. However, another yarn guiding element which upon stretching of the yarn under the action of the drawing force supports easy sliding of the yarn into the pinch zone is optionally provided at the outlet side.

In the embodiments where the blow-out direction is inclined, the inclined blow-out direction of the directional nozzle ensures that the yarn, when being threaded, reliably enters into the guide element and is guided by said element into the predetermined path.

Furthermore, the embodiment where the directional nozzle is formed as an ejector, suction and blow nozzle discussed herein with respect to FIGS. 3 and 4 is especially expedient, as the ejector, suction and blow nozzle sucks the yarn arriving from the yarn feeder and further conveys it under pressure towards the guide element.

An embodiment which is of simple construction and technically advantageous with respect to production and assembly is provided by forming the directional nozzle (FIG. 4) between the two molded members (26a and 26b).

A further embodiment relates to the yarn brake having the shielding surface 20 (FIGS. 3–4 and 8–9) whose task is to prevent the yarn from getting entangled on the yarn brake and to facilitate threading. The ejectors, suction and blow nozzle can be easily integrated into the base member of the shielding element. As discussed above, the yarn to be threaded, which has been moved to the shielding element in any desired manner, is sucked into the passage channel and then moved in the yarn brake to the guide element which guides it around the pinch zone towards the yarn receiver before the yarn receiver stretches the yarn by the action of a drawing force and moves it into the pinch zone.

Where the guide element L is adjustable, this arrangement is constructionally simple because the basic body or the base member is used for securing the guide element. The adjustability of the guide element permits adaptation to the respective operational conditions.

In the embodiment wherein two identical guide elements are provided (FIG. 1), it is ensured from the start that the yarn to be threaded passes to the yarn receiver at any rate, independently of the side of the pinch zone at which it is conveyed. Especially with a disc brake whose round brake discs divide the air flow, it is possible to transport the yarn once to the one side and once to the other side of the pinch zone. When two guide elements are symmetrically arranged, correct threading is ensured at any rate.

We claim:

1. A device for guiding and braking a yarn running in an approximately linear direction along a yarn running path, comprising a yarn feeder which keeps said yarn ready for delivery, and a yarn receiver disposed in said yarn running path downstream of said yarn feeder for drawing off said yarn from said yarn feeder under the action of a drawing force, said device including a yarn brake which is arranged in said yarn running path between said yarn feeder and said yarn receiver, said yarn brake comprising two braking elements having means for being flexibly pressed together such that said brake elements are pressed in a direction transverse to the yarn running direction flexibly against each other and define a pinch zone which brakingly acts on said yarn when said yarn runs along said yarn path in between said braking elements, said device further including a pneumatic threader for producing at least one airflow approximately in the yarn running direction which conveys said yarn forwardly toward said yarn brake, comprising the improvement wherein said yarn brake comprises at least one guide element for guiding said air flow and said yarn, said guide element surrounding said pinch zone of said braking elements without contact, said guide element comprising a receiving end located in said yarn running direction upstream of said pinch zone and laterally adjacent to said yarn running path, a delivery end located downstream of said pinch zone and oriented towards said yarn running path, and a guide channel which connects said receiving end and said delivery end, said guide channel having an open side which is open towards said braking elements such that said yarn is conveyed for threading purposes by means of said air flow through said guide channel and past said pinch zone to said yarn receiver, and is introduced into said pinch zone between said two braking elements under the action of said drawing force produced in said yarn.

2. The device according to claim 1, wherein said guide element is regularly or irregularly bent when viewed from the side.

3. The device according to claim 1, wherein said guide element when viewed laterally comprises a plurality of straight sections which are adjacent to each other and define at least one obtuse angle therebetween.

4. The device according to claim 1, wherein said guide channel is approximately U-shaped or V-shaped.

5. The device according to claim 1, wherein said guide element is a round or profiled tube at least in a longitudinal section, and is partially closed on said open side except for a small longitudinal slot which is oriented towards said pinch zone.

6. The device according to claim 1, wherein said brake elements comprise braking discs which are pressed together to define a circular pinch zone, said guide element surrounding said brake discs over a range from about 100° up to but not more than 180° of an outer circumference of said brake discs.

7. The device according to claim 1, wherein said yarn brake is a lamella brake, said brake elements defining a linear or bar-shaped pinch zone oriented perpendicular to said yarn running direction, said guide element having an arcuate shape so as to bypass said pinch zone.

8. The device according to claim 1, wherein said yarn brake comprises at least one inlet yarn guide provided at an inlet side of said yarn brake upstream of said receiving end of said guide element and disposed on a main body of said yarn brake.

9. The device according to claim 1, wherein said pneumatic threader comprises a directional nozzle proximate an inlet side of said yarn brake, said directional nozzle defining a blow-out direction for said air flow which is oriented towards said pinch zone approximately in said yarn running direction.

10. The device according to claim 9, wherein said blow-out direction is inclined towards said receiving end of said guide element.

11. The device according to claim 9, wherein said directional nozzle is an ejector, suction and blow nozzle which includes means for suctioning and blowing air therethrough to define said air flow which suctions said yarn into said ejector, suction and blow nozzle and ejects said yarn therefrom in said blow-out direction.

12. The device according to claim 11, wherein said directional nozzle is formed between two molded members which are inserted into each other and disposed upstream of said receiving end, said guide element being arranged on one of said molded members which is formed integral therewith.

13. The device according to claim 12, wherein a shielding element which comprises a passage channel is arranged in said guiding element, said shielding element comprising a base member which is defined by said molded members and accommodates said directional nozzle which is operative into said passage channel.

14. The device according to claim 1, wherein said guide element is adjustably arranged on a main body of said yarn brake.

15. The device according to claim 1, wherein two identical guide elements which are symmetrically arranged relative to said yarn running path are provided on opposite sides of said brake discs.

16. The device according to claim 1, wherein said yarn brake is a disc brake and said brake elements are brake discs which define said pinch zone.

17. The device according to claim 1, wherein said yarn brake is a lamella brake and at least one of said brake elements is a brake lamella which defines said pinch zone.

* * * * *

UNITED STATES PATENT AND TRADEMARK OFFICE

CERTIFICATE OF CORRECTION

PATENT NO. : 5,706,868

DATED : January 13, 1998

INVENTOR(S) : Joachim FRITZSON et al

It is certified that error appears in the above-indentified patent and that said Letters Patent is hereby corrected as shown below:

Column 7, line 45; change "brake elements" to ---braking elements---.

Column 8, lines 14 and 15; change "brake elements" to ---braking elements---;

line 21; change "brake elements" to ---braking elements---;

line 59; change "brake discs" to ---braking elements---;

line 62; change "brake elements" to ---braking elements---; and lines 64 and 65; change "brake elements" to ---braking elements---.

Signed and Sealed this

Sixteenth Day of June, 1998

*Attest:*

*Attesting Officer*

BRUCE LEHMAN

*Commissioner of Patents and Trademarks*